US007717716B2

(12) United States Patent
Dahms

(10) Patent No.: US 7,717,716 B2
(45) Date of Patent: May 18, 2010

(54) PIVOTING PRINTED BOARD CONNECTOR

(75) Inventor: Thomas Dahms, Espelkamp (DE)

(73) Assignee: Harting Electronics GmbH & Co. KG (DE)

( * ) Notice: Subject to any disclaimer, the term of this patent is extended or adjusted under 35 U.S.C. 154(b) by 4 days.

(21) Appl. No.: 12/270,702

(22) Filed: Nov. 13, 2008

(65) Prior Publication Data

US 2009/0149086 A1 Jun. 11, 2009

(30) Foreign Application Priority Data

Dec. 8, 2007 (DE) ..... 10 2007 059 254

(51) Int. Cl.
*H01R 12/00* (2006.01)

(52) U.S. Cl. ..... 439/63; 439/248; 439/581

(58) Field of Classification Search ..... 439/63, 439/581, 83, 247–248, 8, 848
See application file for complete search history.

(56) References Cited

U.S. PATENT DOCUMENTS 5,980,290 A 11/1999 Meynier et al.
6,079,986 A * 6/2000 Beshears ..... 439/63
6,497,579 B1 * 12/2002 Garbini ..... 439/63
7,018,216 B1 * 3/2006 Clark et al. ..... 439/63
7,112,078 B2 * 9/2006 Czikora ..... 439/248

FOREIGN PATENT DOCUMENTS

EP 1 246 304 10/2002

* cited by examiner

*Primary Examiner*—Xuong M Chung-Trans
(74) *Attorney, Agent, or Firm*—Hayes Soloway P.C.

(57) ABSTRACT

In order to realize the electric contacting of two parallel printed boards, the invention proposes a printed board connector that features coaxial plug modules realized in the form of pin and socket contacts.

For this purpose, it is proposed that the two plug modules have such a design that they can be turned and tilted about their central mating axis within a certain range on the printed board in order to compensate misalignments or deviations between the positions of the printed boards relative to one another.

It is furthermore proposed to realize certain distances between the printed boards by means of plug modules of different lengths on the pin side.

9 Claims, 7 Drawing Sheets

PIVOTING PRINTED BOARD CONNECTOR

BACKGROUND OF THE INVENTION

1. Field of the Invention

The invention pertains to a printed board connector for electrically contacting two parallel printed boards that comprises at least two plug modules realized in the form of a coaxial contact pair, wherein a pin contact is arranged in one plug module and a socket contact is arranged in the other plug module, and wherein the pin contact or socket contact is centrally held in an insulation element that is surrounded by an electrically conductive sleeve contact.

2. Description of the Related Art

A device of this type is required for mutually contacting two at least approximately parallel printed boards, wherein the design of the contact elements also makes it possible to compensate a misalignment or an offset between the positions of the plug modules and of the printed boards relative to one another to a certain degree.

EP 1 246 304 B1 discloses a coaxial connector, in which a center contact with a spherical head is contacted within a U-shaped spring contact such that it can be turned by a certain angle.

Furthermore, U.S. Pat. No. 5,980,290 discloses an electric coaxial connector with a movable contact, in which, however, only one of the two plug components is arranged in a movable fashion.

Known coaxial connectors of this type for directly contacting two printed boards typically feature two identical and rigid contact modules or even barrel-shaped spacer elements and therefore only able to conditionally compensate a shift or a misalignment between individual modules.

SUMMARY OF THE INVENTION

The invention consequently is based on the objective of realizing a device of the initially described type in such a way that the coaxial plug modules are realized in a self-catching fashion in order to compensate certain deviations between the positions of two printed boards and to also easily bridge different distances between the printed boards without a special spacer element.

This objective is attained in that a contact holder with a central opening is arranged on each of the printed boards, wherein a contact element with an integral spherical structure is fixed within said a central opening such that it is spaced apart from the contact holder, wherein the pin or socket contact features in an internal bore a spherical recess that mechanically and electrically contacts the integral spherical structure of the contact element, wherein the electrically conductive sleeve contact features a slotted socket with a concavely shaped contact region that contacts a crowned ring formed into the central opening of the contact holder, and wherein the recess of the pin contact and the integral spherical structure of the contact element, as well as the concave contact region within the crowned internal ring of the contact holder, make it possible to turn and tilt the sleeve contact within a certain axial range together with the pin or socket contact such that deviations between the positions of the plug modules on the two printed boards can be compensated.

The advantages attained with the invention can be seen, in particular, in that a coaxial plug module in the form of a printed board connector is disclosed that has an exceptionally simple design and is realized in the form of a pin or socket contact, wherein a ball-and-socket joint makes it possible to pivot the contacts by a certain amount that, however, is dependent on the spacing between the printed boards and lies at about ±5° if the boards are spaced apart by 6 mm. This makes it possible to compensate misalignments of about 0.5 mm between the plug modules on the two printed boards.

In this case, it should be noted that each of the two plug modules can be turned and pivoted about its mating axis.

In order to easily "catch" the respective mating plug module, the plug module equipped with the pin contact advantageously features a sleeve contact with a bell-shaped opening, into which the socket contact can be inserted with a crowned projection that is realized circumferentially for contacting purposes and arranged on its sleeve contact on the pin side.

It is furthermore advantageous that height differences between the plug modules of about 1.2 mm can be compensated without additional measures in the above-described instance.

Greater distances between the printed boards can be bridged with an extension of the plug module on the pin side such that no additional adapters are required for bridging the distance between the printed boards. Another aspect to be emphasized are the extremely small dimensions that merely require an area of 5×5 mm per plug module.

Although relatively expensive turning parts are required, this can be compensated with a number of identical components in the pin and socket contacts. It is furthermore possible to utilize such a plug combination for designing a multi-contact plug with an arrangement of several individual contacts.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1A:
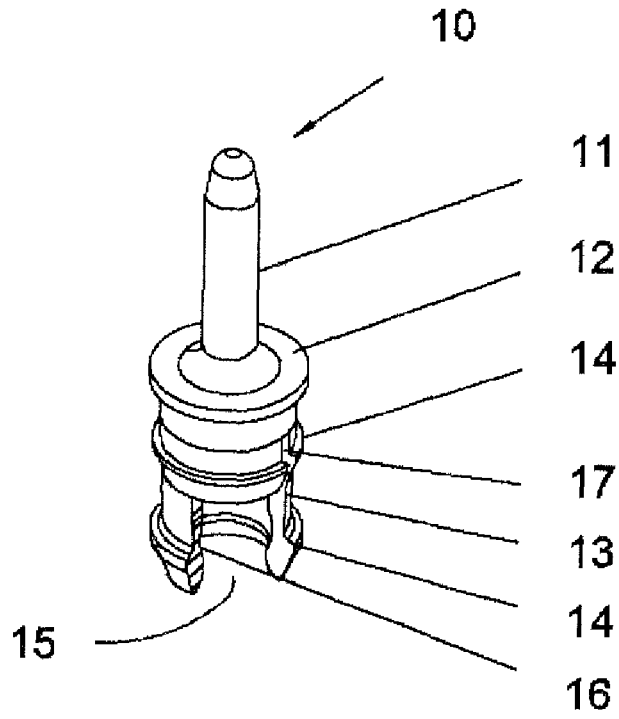
FIG. 1*a* a perspective view of a pin contact.
Figure 1B:
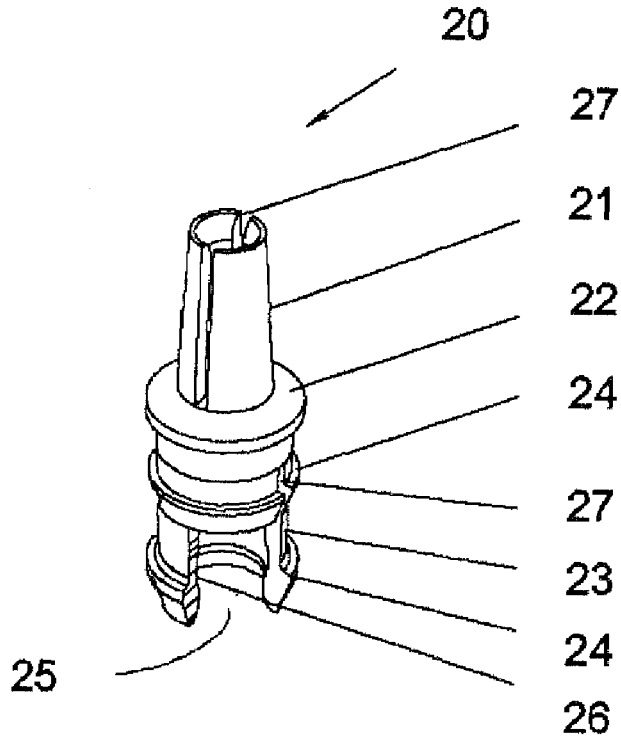
FIG. 1*b* a perspective view of a socket contact.

FIGS. 1*a*, 1*b* respectively show an internal contact of a coaxial plug module in the form of a pin contact and a socket contact of nearly identical design. The only difference is that the mating side of the socket contact 20 is realized in a pin-shaped fashion, but features a slotted socket 21 while the pin contact 10 features a closed pin 11.

The mating regions of the pin 11 and the socket 21 respectively end at a shoulder 12, 22 that is followed by a slotted sleeve part 13, 23 with several radial projections 14, 24.

Within the sleeve part 13, 23, an axial bore 15, 25 is provided with a spherical recess 16, 26, into which an integral spherical structure 41 of a contact element 40 subsequently engages during the installation.

Figure 2A:
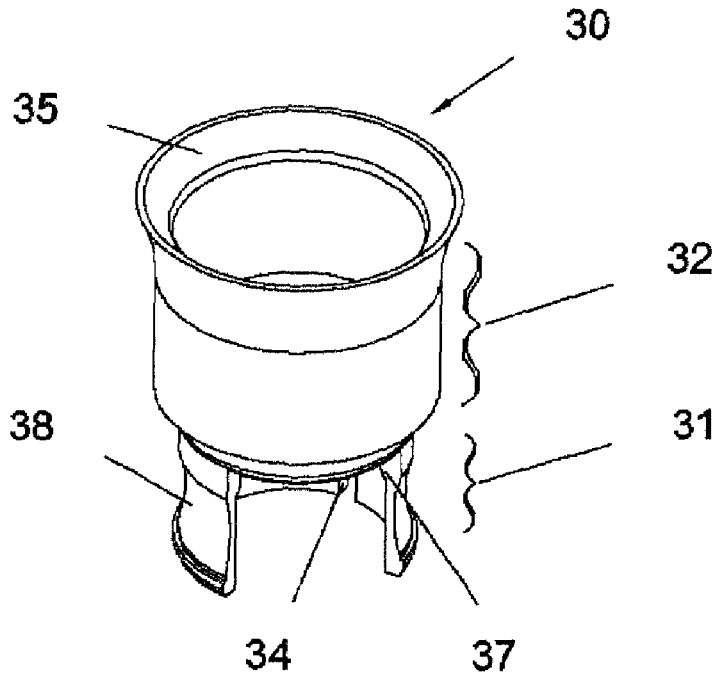
FIG. 2*a* a perspective view of a sleeve contact realized with a funnel.
Figure 2B:
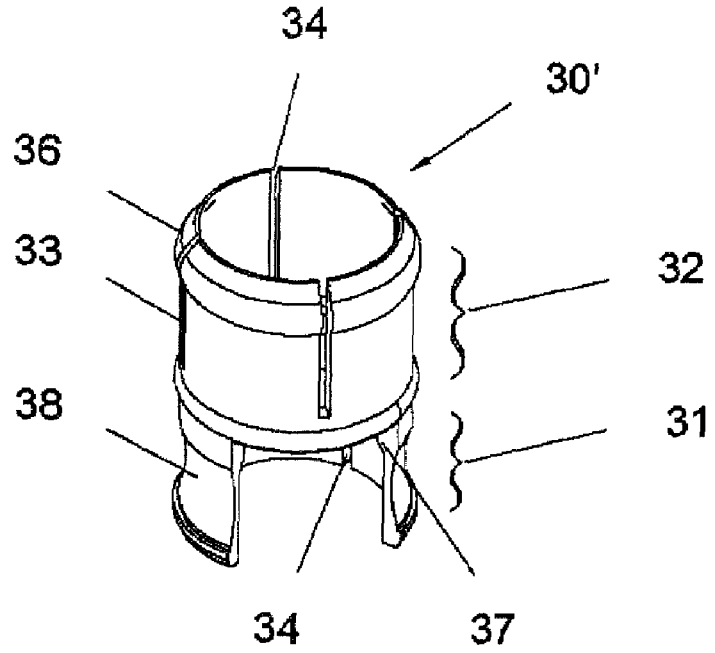
FIG. 2*b* a perspective view of a sleeve contact realized with a contact ring.

FIG. 2*a* and FIG. 2*b* show the sleeve contacts 30, 30' of the coaxial printed board connector that represent the external contact of the coaxial plug module.

In this case, FIG. 2*a* shows the sleeve contact 30 belonging to the pin contact and FIG. 2*b* shows the sleeve contact 30' belonging to the socket contact.

The two sleeve-shaped bodies respectively feature an identical slotted socket 31, by means of which they are held in a contact holder 45 such that they can be turned and tilted, as well as a mating region 32 for being contacted with the respective mating connector.

The sleeve contact 30 features a funnel-shaped contact opening 35 while the sleeve contact 30' features a mating region in the form of a slotted sleeve 33 that contains four slots 34 in this embodiment and is provided with a circumferential outer projection 36 of annular design in order to ensure an adequate contact in the funnel-shaped contact opening 35 of the sleeve contact 30.

The interior of the slotted socket 31 of both sleeve contacts 30, 30' is respectively provided with a convex ring 37 that engages into a concave external groove 52 of an insulation element 50 that also serves for fixing the inner pin contact 10 or the socket contact 20 within the outer sleeve contact 30, 30'. The slotted socket 31 features an outer contact region 38 of concave design that allows a certain pivoting motion within the contact holder 45 that features an opening 47 with a crowned ring 48 for this purpose.

Figure 3:
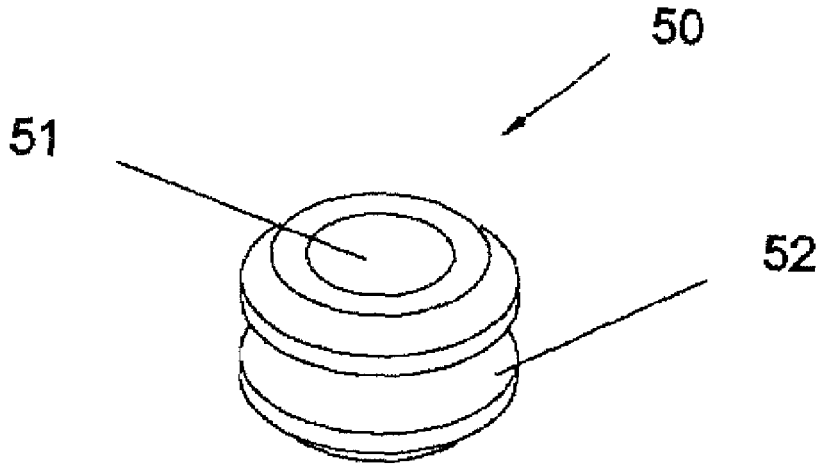
FIG. 3 a perspective view of an insulation element.

FIG. 3 shows the insulation element 50 that consists of an insulating material and is realized circularly with a central opening 51. The wall is provided with an external groove 52 of concave design.

The insulation element 50 accommodates the pin or socket contact 10, 20 in the opening 51 and keeps it spaced apart and insulated from the outer sleeve contact 30, 30'.

Figure 4:
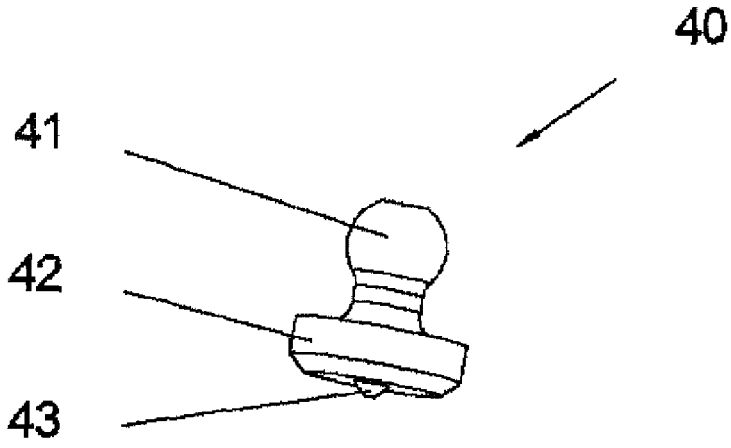
FIG. 4 a perspective view of a contact element.

FIG. 4 shows the contact element 40 for being soldered on a printed board 5. The contact element 40 produces the connection between the two internal contacts—pin and socket contacts 10, 20—and the printed board 5, wherein an integral spherical structure 41 is provided on a disk-shaped leg 42 in order to realize the contacting with the internal contacts.

On the opposite side of the integral spherical structure 41, the leg 42 features a conical point 43 for being soldered on the printed board 5.

During the mounting of the plug modules, the contact element 40 is arranged centrally within the opening 47 of the contact holder 45, but spaced apart therefrom as shown in FIG. 6.

Figure 5A:
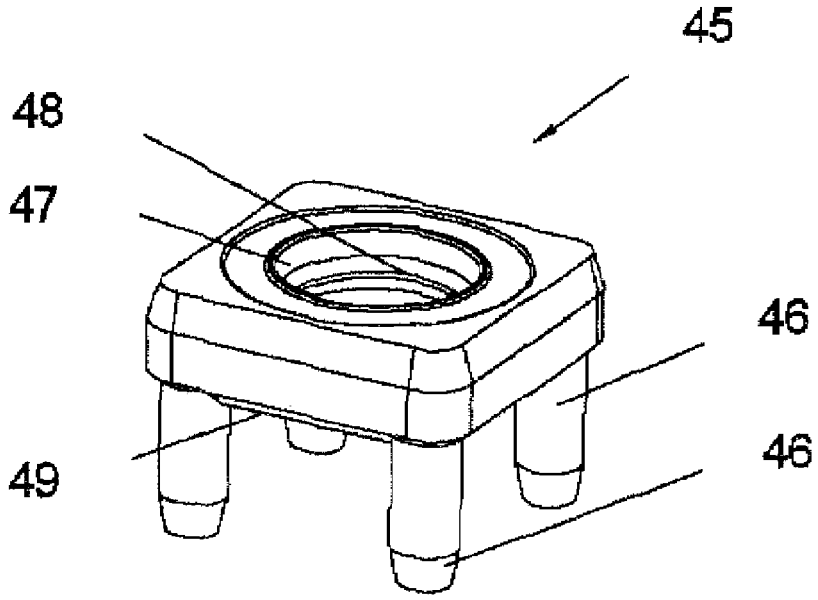
FIG. 5*a* a perspective view of a contact holder with positioning pins.

The contact holder 45 in FIG. 5*a* is realized in the form of a flat, square element with integral positioning pins 46 that are arranged in its corner regions and serve for the primary transmission of the retention forces of the plug module to the printed board. A circumferential ring (between the positioning pins in this embodiment)—a soldering tag 49—produces a shielding effect of the contact holder 45 for the contact element 40.

In its central opening 47, the contact holder 45 features an internal circumferential ring 48 of crowned design that serves for realizing the contacting with the inner concave contact region 38 of the sleeve contact 30, 30'.

Figure 5B:
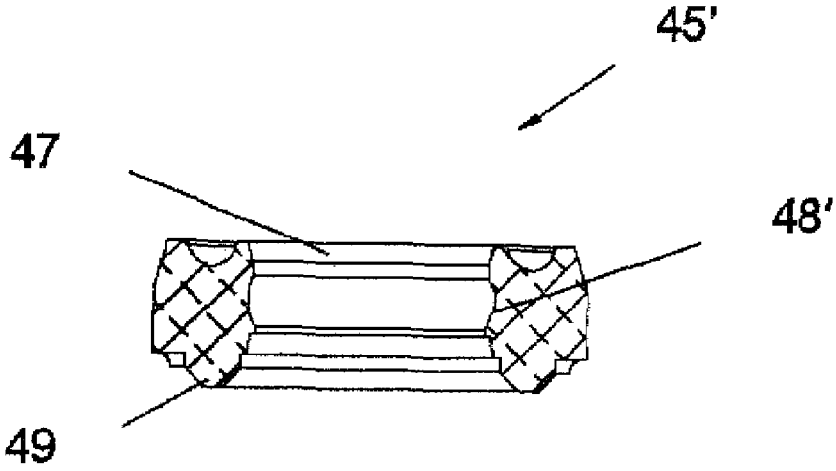
FIG. 5*b* a sectional model of a contact holder for surface-mounting.

FIG. 5*b* shows a central section through a variation of the contact holder 45 that features a contact holder 45' that can be surface-mounted by means of soldering, namely directly on a printed board 5 without any positioning pins by means of the soldering tags 49, and the interior of which features a concave ring 48'.

Figure 6A:
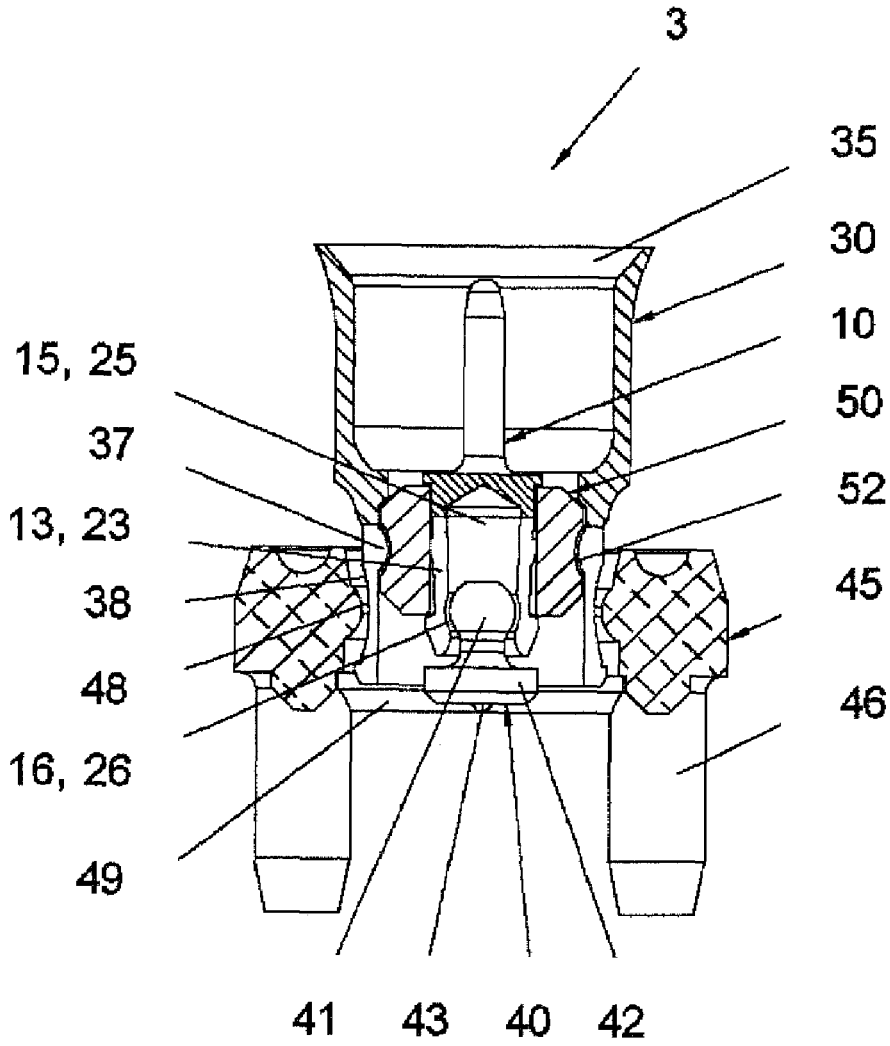
FIG. 6*a* a sectioned model of a mounted plug module.

FIG. 6*a* shows a partially sectioned representation through a mated printed board connector.

This figure shows also a plug module 3 with a pin contact 10 that is fixed in the insulation element 50 such that it contacts the contact element 40, wherein said plug module is surrounded by the sleeve contact 30 and movably held in the contact holder 45.

It is obvious that a pivoting motion of the sleeve contact 30 can primarily be realized due to the spherical recess 16 of the pin contact 10 and the integral spherical structure 41 of the contact element 40 to be fixed on a printed board.

Furthermore the motion is simultaneously realized due to the concave contact region 38 of the slotted socket 31 within the crowned internal ring 48 of the contact holder 45.

Figure 6B:
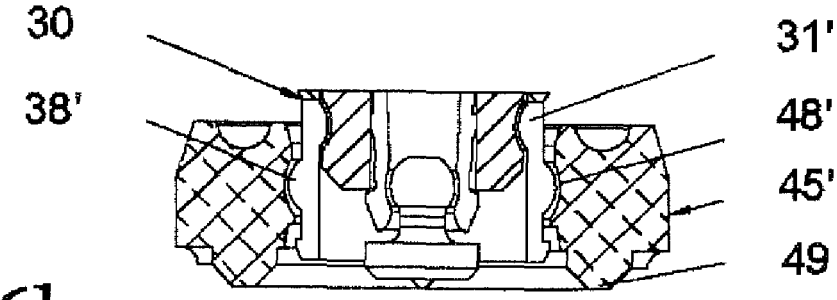
FIG. 6*b* an enlarged detail for a structural variation of the plug module according to FIG. 6*a;*

A variation thereof is illustrated in the form of a detail in FIG. 6*b*. This figure shows the structural alterations of the external contacting between the contact holder 45' and the slotted socket 31' of the sleeve contact 30, 30' which were already indicated in FIG. 5*b*. In this case, the contact region 38' is realized convexly, i.e., in a barrel-shaped fashion, and movably held in the concave ring 48' of the contact holder 45.

The contact holder may also be optionally provided with positioning pins.

Figure 7A:
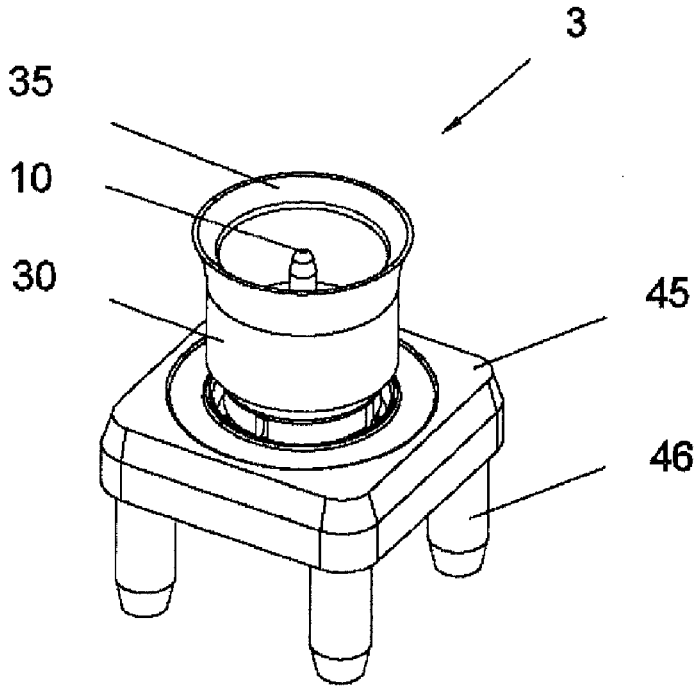
FIG. 7*a* a perspective view of a mounted pin module.
Figure 7B:
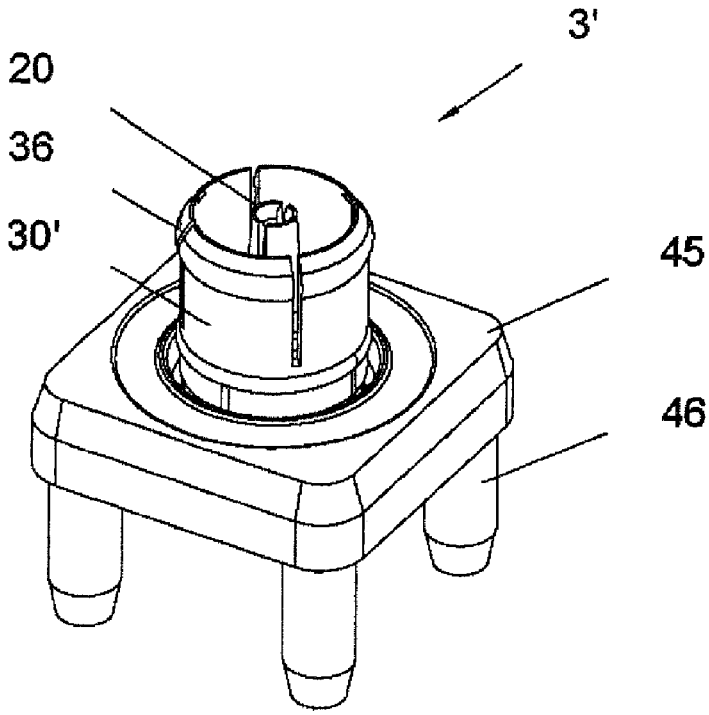
FIG. 7*b* a perspective view of a mounted socket module.

FIGS. 7*a* and 7*b* respectively show a mounted plug module 3 and 3' with the contact holder 45 and its positioning pins 46, the sleeve contacts 30, 30' and the corresponding pin and socket contacts 10, 20.

Figure 8:
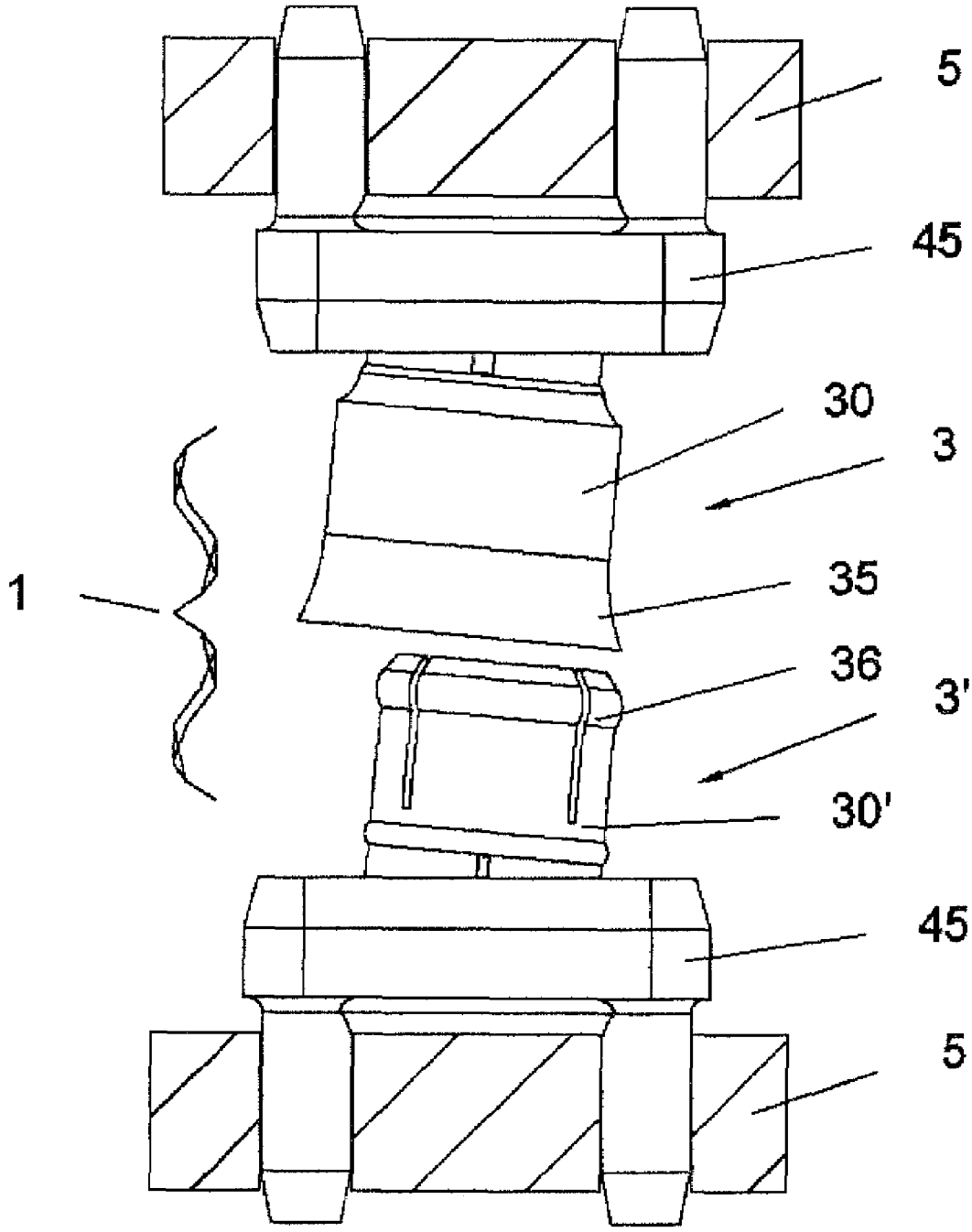
FIG. 8 two plug modules to be mated with printed board.

FIG. 8 shows two plug modules 3, 3' to be mated that are respectively arranged on a printed board 5 with a slight lateral offset that still makes it possible to "catch" the mating region 32 of the sleeve contact 30' in the funnel 35 of the sleeve contact 30.

What is claimed is:

1. A printed board connector for electrically connecting two substantially parallel printed boards, comprising:

at least two plug modules forming a coaxial contact pair;

a pin contact arranged in a first of said plug modules and a socket contact arranged in a second of said plug modules, each of the pin contact and the socket contact being held centrally within the respective plug module by an insulation element surrounded by an electrically conductive sleeve contact;

a contact holder arranged on each of the two substantially parallel printed boards, each contact holder having a central opening, wherein a contact element is arranged within each of said central openings such that it is spaced apart from the contact holder, each contact element having an integral spherical structure;

wherein each of the pin contact and the socket contact features an internal bore having a spherical recess whereby each mechanically and electrically contacts the integral spherical structure of the contact element; and wherein the electrically conductive sleeve contact features a slotted socket with a concavely shaped contact region that contacts a crowned ring formed into the central opening of the contact holder; and wherein the electrically conductive sleeve contact together with the pin contact or the socket contact are tiltable or turnable to an extent such that a misalignment of the relative positions of the plug modules on the two printed boards can be compensated.

2. The printed board connector according to claim 1, wherein the electrically conductive sleeve contact features a slotted socket with a convexly shaped outer region that contacts a concave annular groove formed into the central opening of the contact holder.

3. The printed board connector according to claim 1, wherein the insulation element is positioned within the electrically conductive sleeve contact, and wherein the pin contact is fixed within the central opening of the insulation element.

4. The printed board connector according to claim 1, wherein the insulation element is circularly designed and features a concavely shaped, radial groove in its outer wall.

5. The printed board connector according to claim 1, wherein the contact holder is in the form of a flat polygonal element that is annularly closed and features a central opening, as well as a plurality of integral positioning pins in corner regions of the contact holder.

6. The printed board connector according to claim 1, wherein the contact holder features circumferential soldering tags toward the soldering side of the printed board.

7. The printed board connector according to claim 1, wherein pin contacts and corresponding electrically conductive sleeve contacts are provided with different lengths for different distances between the printed boards.

8. The printed board connector according to claim 1, wherein the contact element features a leg with an integral spherical structure, as well as a conical soldering point.

9. The printed board connector according to claim 1, wherein the insulation element is positioned within the electrically conductive sleeve contact, and wherein the socket contact is fixed within the central opening of the insulation element.

* * * * *